US006010661A

United States Patent [19]

Abe et al.

[11] Patent Number: 6,010,661

[45] Date of Patent: Jan. 4, 2000

[54] METHOD FOR PRODUCING HYDROGEN-CONTAINING SPONGE TITANIUM, A HYDROGEN CONTAINING TITANIUM-ALUMINUM-BASED ALLOY POWDER AND ITS METHOD OF PRODUCTION, AND A TITANIUM-ALUMINUM-BASED ALLOY SINTER AND ITS METHOD OF PRODUCTION

[75] Inventors: Toshihiko Abe; Hitoshi Hashimoto; Young Ho Park, all of Miyagi-ken, Japan

[73] Assignee: Japan as represented by Director General of Agency of Industrial Science and Technology, Japan

[21] Appl. No.: 09/266,260

[22] Filed: Mar. 11, 1999

[51] Int. Cl.[7] ..... B22F 1/00; C22C 1/04; C22C 14/00; C22C 21/00; C22F 1/04

[52] U.S. Cl. ..... 420/418; 420/552; 420/900; 419/31; 419/34

[58] Field of Search ..... 419/31, 34; 420/552, 420/900, 418

[56] References Cited

U.S. PATENT DOCUMENTS

| | | | |
|---|---|---|---|
| 4,369,078 | 1/1983 | Aslund | 148/126 |
| 4,373,947 | 2/1983 | Büttner et al. | 75/0.5 BB |
| 4,470,847 | 9/1984 | Hard et al. | 75/84.4 |
| 4,505,764 | 3/1985 | Smickley et al. | 148/133 |
| 4,655,825 | 4/1987 | Hard et al. | 75/5 B |
| 4,923,531 | 5/1990 | Fisher | 148/126.1 |
| 4,957,421 | 9/1990 | Baldi | 419/8 |
| 5,024,813 | 6/1991 | Nishiyami | 420/402 |
| 5,032,176 | 7/1991 | Kametani et al. | 75/416 |
| 5,409,518 | 4/1995 | Saito et al. | 75/44 |

OTHER PUBLICATIONS

Fujii et al., "Production of Ti–48 mol% Al Intermetallic Compound by Mechanical Milling and Vacuum Hot Pressing of Titanium Hydride and Aluminum Powders", J. Japan Inst. Metals, vol. 62, No. 5, pp. 462–468, 1998 (English language Abstract on first page).

*Primary Examiner*—Daniel J. Jenkins
*Attorney, Agent, or Firm*—Howson and Howson

[57] ABSTRACT

The methods of the present invention provide efficient mechanical milling or alloying of stock materials of titanium and aluminum in order to increase yield of the titanium stock and reduce cost in connection with the production of a titanium-aluminum-based alloy sinter. Sponge titanium, which has a particle size of 1 to 20 mm and which contains hydrogen at 3.5 mass % or more, is used as the titanium stock. The sponge titanium is ball-milled with an aluminum stock in an argon atmosphere to produce a hydrogen-containing titanium-aluminum-based alloy powder. Furthermore, this powder may be sintered, as required.

8 Claims, No Drawings

METHOD FOR PRODUCING HYDROGEN-CONTAINING SPONGE TITANIUM, A HYDROGEN CONTAINING TITANIUM-ALUMINUM-BASED ALLOY POWDER AND ITS METHOD OF PRODUCTION, AND A TITANIUM-ALUMINUM-BASED ALLOY SINTER AND ITS METHOD OF PRODUCTION

FIELD OF THE INVENTION

The present invention relates to production of a titanium-aluminum-based alloy by mechanical milling (including mechanical alloying) of sponge titanium blocks (titanium), treated for absorbing hydrogen. More specifically, the present invention relates to a method for producing hydrogen-containing sponge titanium, and a hydrogen-containing titanium-aluminum-based alloy powder and its method of production, and a titanium-aluminum-based alloy sinter and its method of production. For purposes of this application, "titanium-aluminum-based alloy" refers to a composition which comprises a titanium-aluminum system as the major ingredient of the alloy and which is permitted to contain one or more other ingredients to the extent that the inherent properties of the major ingredient are not damaged. The term "-based" is used in a similar manner in this specification.

BACKGROUND OF THE INVENTION

Recently, intermetallic compounds, such as titanium-aluminum-based, nickel-aluminum-based, iron-aluminum-based and iron-cobalt-based compounds, have been attracting attention as heat-resistant materials.

Alloys in general have dissimilar atoms arranged irregularly at each lattice of the crystal structure. On the other hand, intermetallic compounds have regular structures with constituent atoms arranged at specific positions to exhibit interesting deformation behavior. For example, they can exhibit apparently abnormal phenomena in that their strength conversely increases as deformation temperature increases within a certain range. Such phenomena make these compounds noted as heat-resistant, high-strength materials.

Of these titanium-aluminum-based intermetallic compounds, TiAl and $Ti_3Al$ are attracting attention as structural materials for engine members which are subject to high temperatures, such as those for aerospace devices and automobiles, because of their low density, lightness and high specific strength relative to heat resistance.

Titanium-aluminum-based alloys are generally produced by a melting method, in which stocks are molten and cast. This method has its problems, for example, component segregation (gravity segregation) in which titanium is separated from aluminum of lower density during the solidification step, and coarse grains which grow to 100 $\mu$m or more and deteriorate the desired quality.

Moreover, the melting method requires an expensive melting unit, e.g., a vacuum arc melting furnace, and makes it difficult to produce titanium-aluminum-based intermetallic compounds having target characteristics.

A powder metallurgical process is considered an effective substitute for the above-referenced melting method. To produce titanium-aluminum-based intermetallic compounds in a powder metallurgical method, it is necessary to alloy powdered titanium and aluminum by mechanical milling in a pot (mill) with hard mixing balls. This includes repeated mixing, milling and adhesion under pressure of these components, in order to secure fine, isometric grains of uniform size and thereby to improve their mechanical properties. This process is referred to as mechanical alloying.

To produce titanium-aluminum-based metallic compound powders, mechanical alloying normally has been effected by ball-milling the stock powders of titanium and aluminum in an inert atmosphere (e.g., argon) or under a vacuum to prevent oxidation of the intermetallic compound powders.

However, this method is also subject to problems, for instance, low product yield can be provided even when the stock powders are milled for extended periods. This is because most powders are deposited on the balls and inner mill walls and are left unreacted. Although mechanical alloying is an effective means to produce a fine intermetallic compound powder of uniform particle size, as discussed above, such a low product yield is an economically critical disadvantage.

Attempts to prevent build-up of the powders in the inner mill walls include milling in a nitrogen or ammonia atmosphere, or in the presence of an organic solvent such as heptane. This method can increase synthesis yield to almost 100%.

Nevertheless, these methods are undesirable, because of formation by these additives of, for instance, carbides or nitrides, which may severely damage sinter structures and mechanical properties of the titanium-aluminum-based intermetallic compound powder. Therefore, the problems involved in the mechanical alloying of titanium and aluminum powders have not been drastically solved.

In an attempt to solve these problems, the use of hydrogenated titanium powder has been proposed in place of the use of pure titanium powder. This method can provide a powder structure with fine hydrogenated titanium and $\alpha$-titanium particles dispersed in aluminum, while increasing synthesis yield to 95% or more without forming a carbide or nitride. A titanium-aluminum-based metallic compound sinter can be readily obtained, because hydrogen is dissociated at around 500° C. Furthermore, hydrogenated titanium powder is 20 to 30% less expensive than pure titanium powder for the conventional mechanical alloying process, which is yet another advantage of this method.

However, the use of fine, pure titanium powder as the suitable stock for mechanical alloying is very expensive. Even when hydrogenated titanium powder is utilized because it is 20 to 30% less expensive than pure titanium powder, the conventional mechanical alloying process still lacks commercial viability.

OBJECTS OF THE INVENTION

It is an object of the present invention to provide a method for producing hydrogen-containing sponge titanium, which permits efficient mechanical milling or alloying with pure aluminum, and which improves product yield of the titanium stock and reduces production cost by use of hydrogen-containing sponge titanium.

It is another object of the present invention to provide a novel hydrogen-containing titanium-aluminum-based alloy powder and a method for production thereof.

It is yet another object of the present invention to provide a novel titanium-aluminum-based alloy sinter and method for production thereof.

SUMMARY OF THE INVENTION

The inventors of the present invention have found, after having studied to solve the above problems, that use of hydrogen-containing sponge titanium in place of pure titanium powder, which gives a poor synthesis yield by mechanical alloying, or hydrogenated titanium powder, can give a titanium-aluminum-based alloy sinter at a lower cost, when the sponge titanium has an adjusted particle size and is treated under controlled hydrogenation conditions, such as controlled pressure and temperature conditions.

Thereby, the inventors have also found that hydrogen-containing titanium-aluminum-based alloy powder and titanium-aluminum-based alloy (intermetallic compound) sinter can be produced under stable conditions at high reproducibility.

The present invention provides a method for producing hydrogen-containing sponge titanium which includes the step of heating the sponge titanium to about 300 to 500° C. for about one minute to one hour in a flow of hydrogen kept at 1 to 5 atmospheres. Preferably, the flow of hydrogen is kept at 1 to 2 atmospheres. In addition, preferably the sponge titanium contains hydrogen at 3.5 mass % or more and has a particle size of 1 to 20 mm.

According to another aspect of the present invention, a hydrogen-containing titanium-aluminum-based alloy powder is provided. The powder includes sponge titanium which contains hydrogen at 3.5 mass % or more and which has a particle size of 1 to 20 mm, and powder, particles or pieces of aluminum. The powder can be used to make a titanium-aluminum-based alloy sinter which contains gases, for instance including oxygen, at 500 ppm or less.

According to yet another aspect of the present invention, a method for producing hydrogen-containing titanium aluminum-based alloy powder is provided. The method includes the step of ball-milling sponge titanium and powder, particles or pieces of aluminum in an argon atmosphere. The sponge titanium has been treated for absorbing hydrogen to contain hydrogen at 3.5 mass % or more and has a particle size of 1 to 20 mm.

According to yet another aspect of the present invention, a method for producing a titanium-aluminum-based alloy sinter containing gases, e.g., oxygen, at 500 ppm or less, is provided. The method includes the step of sintering the hydrogen-containing titanium-aluminum-based alloy powder which is produced by mechanical milling of sponge titanium containing hydrogen at 3.5 mass % or more, and powder, particles or pieces of aluminum.

DETAILED DESCRIPTION OF THE PREFERRED EMBODIMENTS

Sponge titanium, sieved to have a particle size of 50 mm or less, is heated in a furnace (e.g., electrical furnace) at 300 to 500° C. for 1 minute to 1 hour in a flow of hydrogen kept at 1 to 5 atm., preferably 1 to 2 atm. Particle size of the sponge titanium is preferably 10 mm or less, for treatment for absorbing hydrogen (to contain hydrogen), milling (to give fine articles) and homogeneous mixing.

The term "treatment for absorbing hydrogen (to contain hydrogen)" is used in relation to the presence of adsorbed hydrogen. Hydrogenation of sponge titanium proceeds in many cases, as a peculiar phenomenon when it is treated in a flow of hydrogen. Nevertheless, sponge titanium treated for absorbing hydrogen to contain it must be differentiated from titanium hydride. Adsorbed hydrogen will further promote hydrogenation of sponge titanium during milling with aluminum powder, described later.

Sponge titanium has a very high capacity to absorb (contain) hydrogen, conceivably because of its structure providing a large contact area with hydrogen gas.

In the conventional hydrogenation of pure titanium powder, it absorbs a large quantity of oxygen to form the oxide film thereon while it is being crushed. This oxide film decreases strength of the titanium-aluminum sinter. On the other hand, the present invention has the significant advantage of including essentially no oxygen.

Sponge titanium having a particle size of around 10 mm can be treated to contain hydrogen for around 10 minutes and become sufficiently fragile to be broken when pressed by a finger.

It is treated in a flow of hydrogen at 1 to 5 atm., depending on the structure of the furnace in which it is heated. The preferable pressure level is 1 atm, or slightly higher (around 1 to 2 atm), because it can be sufficiently treated to contain hydrogen at 1 atm and inflow of ambient air into the furnace may occur when it is kept under a vacuum, whereas hydrogen may leak out of the furnace when it is kept at above the atmospheric pressure.

It is important that in order for the sponge titanium to contain hydrogen that it is heated at an adequate temperature in the furnace. For example, sponge titanium having a particle size of 3 mm will contain little hydrogen, when kept in a hydrogen atmosphere at room temperature, even at 15 atm for 24 hours, and remain unchanged in fragility. It is therefore necessary to efficiently obtain hydrogen-containing sponge titanium of specified particle size in specified temperature and pressure ranges.

Sponge titanium will contain at least 3.5 mass % of hydrogen when treated for absorbing hydrogen in a manner described above. The sponge titanium treated to contain hydrogen is then ball-milled in a rotary or planetary mill together with particles or debris of aluminum.

Ball-milling is accomplished in an inert atmosphere (e.g., argon or helium) or under a vacuum to prevent inflow of ambient air and resultant oxidation of the powder. Use of pieces (e.g., facets or the like) of aluminum, which contain less oxygen than use of the powder, further reduces oxygen content in the mixed alloy powder and sinter.

Ball-milling of the mixed powder for about 10 to 200 hours results in a mixed alloy powder with aluminum and hydrogen dissolved in α-titanium to form a solid solution. The homogeneously mixed powder was obtained in a yield of almost 100%, with little aluminum or titanium deposited on the inner mill walls or balls.

The sponge titanium treated to contain hydrogen easily becomes fragile and can be crushed into fine particles, which are by themselves little deposited on the inner mill walls. By crushing the sponge titanium, the hydrogen-containing titanium particles are considered to have an effect of removing deposited aluminum or titanium particles out of the walls.

Milling time can be varied depending on particle size of the aluminum or sponge titanium, and also on conditions under which the sponge titanium is treated to contain hydrogen, in order to secure desired mixed alloy powder.

The ball-milled sponge titanium obtained by a manner described above contains oxygen at 0.05 mass % or less. Ball-milling of titanium and aluminum powders by the conventional method provides a titanium-aluminum alloy powder which contains oxygen at 0.5 to 5 mass %. Therefore, use of hydrogen-containing sponge titanium greatly reduces oxygen content.

Use of hydrogen-containing sponge titanium has another advantage it that it provides a higher-quality titanium-aluminum-based alloy powder, because it dispenses with nitrogen gas or heptane which is required by the conventional method to prevent deposition of the particles on the inner mill walls. Thus, carbide or nitride is not formed in the method of the present invention.

The titanium-aluminum-based alloy powder thus prepared is sintered in a vacuum hot press or the like, where it is dehydrogenated at around 500° C. and then heated to around 800 to 1200° C. The sintering is effected in a reducing atmosphere to prevent oxidation of the stock powder. This provides an alloy of fine structure with intermetallic titanium-aluminum compounds (such as $Ti_3Al$ and TiAl). Residual hydrogen content is 5 ppm or less.

As described above, the titanium-aluminum-based alloy powder, starting from sponge titanium, does not require the crushing of pure titanium to around 10 to 20 $\mu$m which has the effect of significantly increasing production cost. Moreover, hydrogen-containing sponge titanium by itself can be easily crushed into fine particles, making it easy to crush it into fine particles and also simplifying the processes of mixing and alloying them with particles or pieces of aluminum. Overall, use of hydrogen-containing sponge titanium greatly reduces the production cost.

The titanium-aluminum-based intermetallic compound sinter thus obtained contains greatly reduced quantities of impurities, such as oxygen; is not contaminated with carbide or nitride; has a dense, homogeneous structure of the intermetallic compounds; and shows high resistance to heat and rigidity, making it a suitable structural material for, e.g., engine parts which otherwise are damaged by high temperatures associated with aerospace devices and automobiles.

The present invention is described by an Example and a Comparative Example. It is to be understood that the Example provides an embodiment of the present invention and by no means limits the present invention. That is, the present invention is limited by only the claims raised herein which can include a variety of modifications of the Example. The Example described below provides a preferred and representative embodiment of the present invention.

EXAMPLE

High-purity sponge titanium having a particle size of 7 mm (oxygen content:0.05 mass % or less, iron content:10 ppm or less, and Ti content:95.9 mass % or more) was heated in an electrical furnace at 400° C. for 10 minutes in a flow of hydrogen kept at 1 atm, and was then withdrawn from the furnace. It contained hydrogen at about 4 mass %. The sponge titanium treated to contain hydrogen became sufficiently fragile as to be easily broken when pressed by a finger.

The above high-purity sponge titanium, treated to contain hydrogen, was mixed with an equimolar aluminum powder (purity:99.98%, particle size:150 $\mu$m or less), and 822 grams of the mixed powder was filled and sealed in a cylindrical mill of stainless steel (SUS 304), 300 mm in inner diameter and 350 mm in inner length, together with 41.1 kg of steel balls, 12.7 mm in diameter.

Next, the mixed powder was ball-milled in the above mill at a rotational speed of 7.43 rad/s (71.0 rpm), after it was evacuated by a rotary pump and purged with a high-purity argon gas.

The ball-milling for 200 hours gave a mixed alloy powder of a structure in which hydrogenated titanium and $\alpha$-titanium particles were finely dispersed in the aluminum particles. The homogeneously mixed alloy powder was obtained in a yield of almost 100%, with little aluminum or titanium deposited on the inner mill walls or balls. Contamination of the alloy powder with oxygen was rarely observed during the ball milling process.

The titanium-aluminum alloy powder thus obtained was heated to 1100° C. by pulse current, while it was pressed at 50 MPa. The alloy was dehydrogenated at around 500° C. The residual hydrogen content in the final sinter was 5 ppm or less.

As a result, the sintered alloy thus prepared has a fine, dense structure of the intermetallic titanium-aluminum compounds ($Ti_3Al$ and TiAl).

The above process was effected in a reducing atmosphere containing hydrogen, with the result that little oxidation was observed in the sponge titanium, aluminum powder or mixed alloy powder thereof, or sinter which contained oxygen at 0.05% or less.

Furthermore, little titanium or aluminum was deposited on the inner mill walls or balls during the ball-milling process, dispensing with need of nitrogen or other media to help remove them. As a result, no medium-derived carbide or nitride was formed in the sinter.

This was confirmed by X-ray diffractometry, which showed no diffraction peaks relevant to a carbide or nitride.

The intermetallic titanium-aluminum compound sinter, therefore, exhibited not only high specific strength relative to heat resistance, but also improved rigidity.

This result indicates that treatment of sponge titanium to contain hydrogen can be effected relatively easily in a stable manner. The sponge titanium particles are provided in a fine particle form for the purpose of production and because their capability of absorbing hydrogen increases as their size decreases.

COMPARATIVE EXAMPLE

For comparison, an equimolar mixture of pure titanium powder (purity:99.7 mass %) and pure aluminum powder (purity:99.9 mass %) were filled and sealed in a cylindrical mill of stainless steel (SUS 304), 300 mm in inner diameter and 350 mm in inner length, together with 41.1 kg of steel balls, each 12.7 mm in diameter.

The mixed powder was then ball-milled in the above mill at a rotational speed of 7.43 rad/s (71.0 rpm), after it was evacuated by a rotary pump and purged with a high-purity argon gas.

The mixed powder was withdrawn from the mill after the mechanical alloying process was completed. The mechanically alloyed mixed powder was obtained at a yield of almost zero, because it was massively deposited on the inner mill walls.

The present invention allows the production of a titanium-aluminum-based alloy sinter at a low cost by use of hydrogen-containing sponge titanium, having an adjusted particle size and obtained by the treatment effected under devised conditions with respect to, e.g., pressure and temperature to absorb hydrogen. The hydrogen-containing sponge titanium is utilized in place of pure titanium powder or hydrogenated titanium powder used by the conventional methods, which provide the mechanically alloyed powder at a very low yield.

It is possible to treat the sponge titanium for 10 minutes in a flow of hydrogen so that it absorbs a desired amount of hydrogen by adequately controlling temperature at a desired level. The treated sponge titanium becomes sufficiently fragile as to be broken when pressed by a finger. The hydrogen containing sponge titanium can be easily crushed into fine particles which also simplifies the processes of mixing and alloying them with particles or pieces of aluminum, to greatly reduce the overall production cost.

The present invention has a notable advantage of giving, at a low production cost, a titanium-aluminum-based intermetallic compound sinter, prepared by sintering the titanium-aluminum-based alloy powder of the hydrogen-containing titanium and particles or pieces of aluminum. The sinter of the present invention contains greatly reduced quantities of impurities, such as oxygen; is not contaminated with carbide or nitride; has a dense, homogeneous structure of the intermetallic compounds; and demonstrates high resistance to heat and rigidity.

Thereby, the sinter is a suitable structural material for, e.g., engine parts for airplanes and automobiles which experience high temperatures.

What is claimed is:

1. A method for producing hydrogen-containing sponge titanium, comprising the step of heating sponge titanium to about 300 to about 500° C. for about 1 minute to about 1 hour in a flow of hydrogen kept at 1 to 5 atm, said sponge titanium having a particle size of about 1 to about 20 mm, and wherein, after said step, said sponge titanium containing at least about 3.5 mass % of hydrogen.

2. A hydrogen-containing titanium-aluminum-based alloy powder, comprising sponge titanium which contains hydrogen at at least about 3.5 mass % and which has a particle size of about 1 to about 20 mm, and powder, particles or pieces of aluminum.

3. A method for producing hydrogen-containing titanium-aluminum-based alloy powder, comprising the step of ball-milling sponge titanium which has been treated for absorbing hydrogen to contain hydrogen at at least about 3.5 mass % and which has a particle size of about 1 to about 20 mm, and powder, particles or pieces of aluminum.

4. A method according to claim 3, wherein the ball-milling step is accomplished in an argon atmosphere.

5. A method according to claim 3, wherein the ball-milling step is accomplished under a vacuum.

6. A titanium-aluminum-based alloy sinter, which is produced from the hydrogen-containing titanium-aluminum-based alloy powder of claim 2 and contains gases of 500 ppm or less.

7. A titanium-aluminum-based alloy sinter according to claim 6, wherein said gases includes oxygen.

8. A method for producing a titanium-aluminum-based alloy sinter containing oxygen gases at 500 ppm or less, comprising the step of sintering a hydrogen-containing titanium-aluminum-based alloy powder produced by mechanical milling of titanium, containing hydrogen at at least 3.5 mass %, and aluminum.

* * * * *